US007188577B2

(12) United States Patent
Colyvas

(10) Patent No.: US 7,188,577 B2
(45) Date of Patent: Mar. 13, 2007

(54) OMNI THRUSTER FOR MOTORBOATS AND MOTORYACHTS

(76) Inventor: Constantine N. Colyvas, 59 Valoric Rd., Southampton, Suffolk, NY (US) 11968

( * ) Notice: Subject to any disclaimer, the term of this patent is extended or adjusted under 35 U.S.C. 154(b) by 0 days.

(21) Appl. No.: 10/634,068

(22) Filed: Aug. 4, 2003

(65) Prior Publication Data

US 2005/0164570 A1 Jul. 28, 2005

(51) Int. Cl.
*B63H 25/46* (2006.01)

(52) U.S. Cl. ..... 114/151

(58) Field of Classification Search ..... 114/144 R, 114/144 B, 150, 151, 183 R; 440/38
See application file for complete search history.

(56) References Cited

U.S. PATENT DOCUMENTS 3,941,076 A * 3/1976 Rice ..... 440/39
4,265,192 A * 5/1981 Dunn ..... 114/151
6,024,038 A * 2/2000 Kiliz et al. ..... 114/151
6,158,371 A * 12/2000 De Risi ..... 114/151

* cited by examiner

*Primary Examiner*—Ed Swinehart
(74) *Attorney, Agent, or Firm*—Wenderoth, Lind & Ponack, L.L.P.

(57) ABSTRACT

A device for enhancing the maneuverability of motorboats and motoryachts includes a high velocity water jet pump (HVWJP) attached to the main engine through an electromagnetic clutch. High velocity water flows from the HVWJP's outlet to bow and stern side nozzles, through solenoid valves, individually controlled from the cockpit. The benefits of the device are that turns and lateral movements will be easier and faster, and extra power for fire fighting and emergency bilge water pumping are also available. Further, if the yacht, while speeding, strikes a rock or other submerged object and the propellers and shafts are destroyed, the crew will use the U section pipe to connect the NVWJP's outlet to an auxiliary propulsion pipe, demonstrate to the tug's skipper that his yacht is not a dead ship on the water, and legally claim and pay the towage fee, instead of the far more expensive salvage fee.

2 Claims, 5 Drawing Sheets

OMNI THRUSTER FOR MOTORBOATS AND MOTORYACHTS

FIELD OF INVENTION

This invention relates to a device for boats, equipped with one or two inboard engines.

DESCRIPTION OF RELATED ART

All types of motor boats have some kind of difficulty when trying to turn around in close quarters and other congested areas, due to the fact that, unlike motor cars that travel on solid ground, boats move and travel on fluid water, where side movement, because of wind and/or current, is not an unusual interference in the operator's intent.

Any additional assistance therefore, to make these maneuvers easier and faster, would always be welcome.

BRIEF SUMMARY OF THE INVENTION

The device that we will describe hereunder, will definitely eliminate the above mentioned disadvantage by placing additional lateral forces at the boat's bow and stern, to be used at the discretion of the boat's operator.

This device is a water jet bow and stern thruster, powered by a high velocity water jet pump, driven by the propulsion engine, through a electromagnetic clutch and operated from the boat's cock-pit by electric switches, as we will see later.

DESCRIPTION OF PRIOR ART

There are in the market bow-thrusters, using electrically, or hydraulically, operated propellers, in a boats bow, which are bulky, requiring large areas to install.

It also shows the pilot light, illuminating the crossed arrows, indicating the kind of performance this switch is intended to do.

Switch C, is identical to the above switch B, with the difference that on the C, the arrows are parallel.

DETAILED DESCRIPTION

Figure 1:
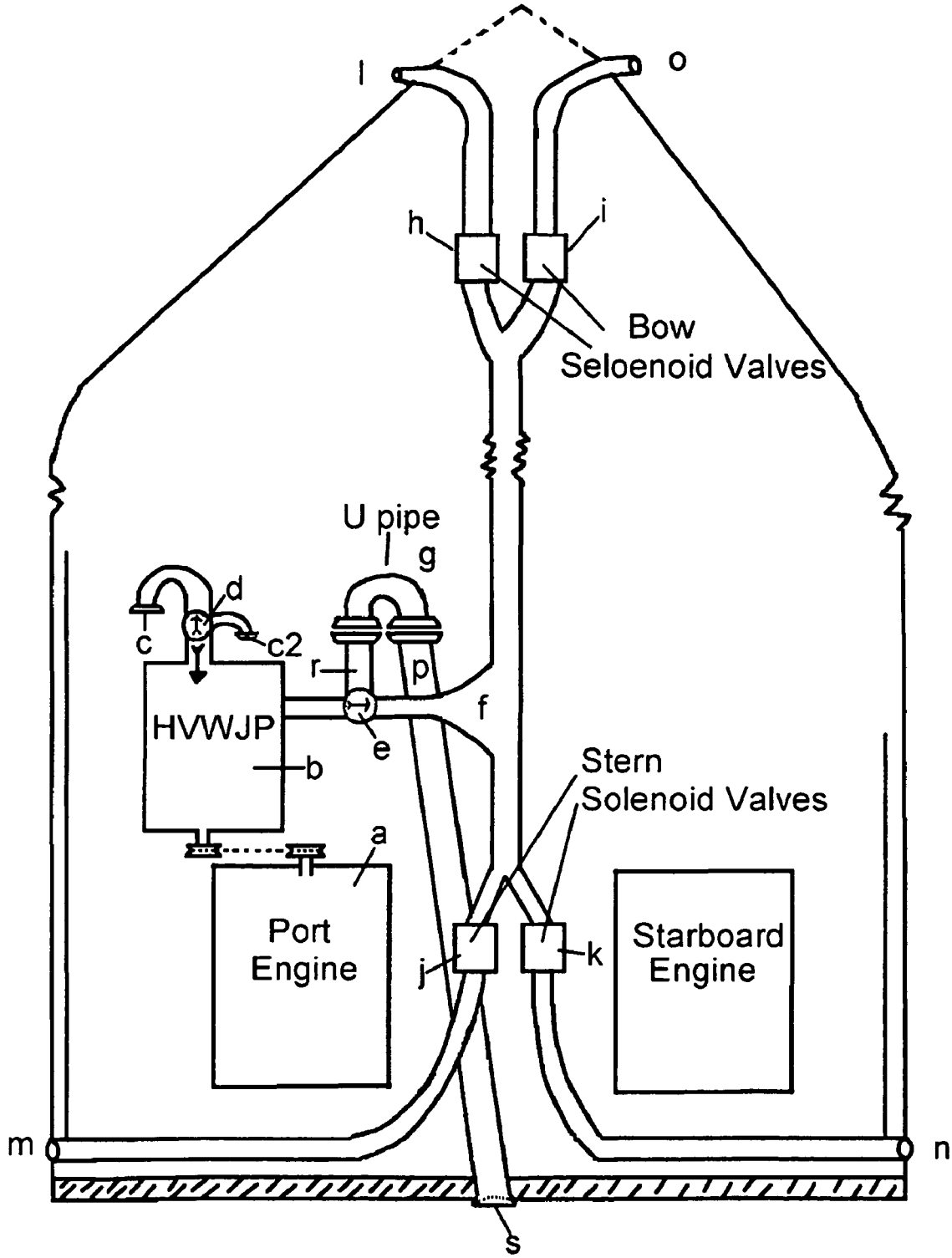
FIG. 1, is a general plan of a twin inboard engine boat, showing the High Velocity Water Jet Pump (HVWJP), a water jet pump similar to the ones used in the personal water crafts, for propulsion, but without the gasoline engine driving it, connected to the port engine, through an electromagnetic clutch (EMC), operated from the boat's cock-pit. It also shows the piping connecting the pump to the bow and stern thruster nozzles and solenoid valves that will explain further later.

As in FIG. 1, the bow and stern thrusters, working in pairs will, either turn the boat quickly to right (clockwise), or to left (counter-clockwise), using switch B, or move the boat sideways, right (starboard direction) or left (port direction), using switch C.

Figure 3:
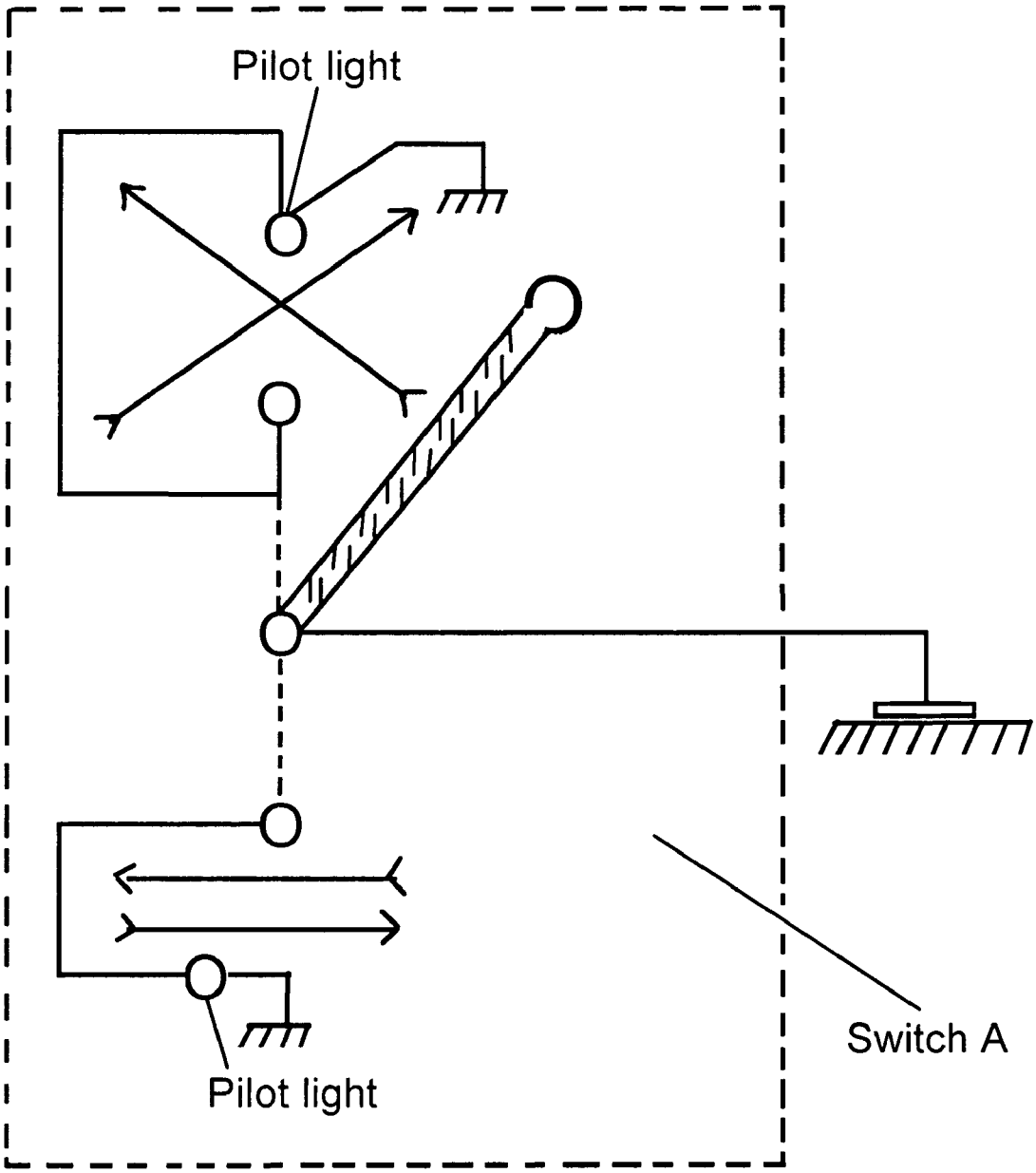
FIG. 3, is an enlarged view plan of the main switch A, that gives power to either switch B, operating the diagonal turning jets, (h) and (k), or (i) and (j) or, switch C, operating the lateral moving jets, (h) and (j) or (i) and (k). Pilot lights illuminate each switch when energized to show which one is on and the operation it performs.
Figure 4:
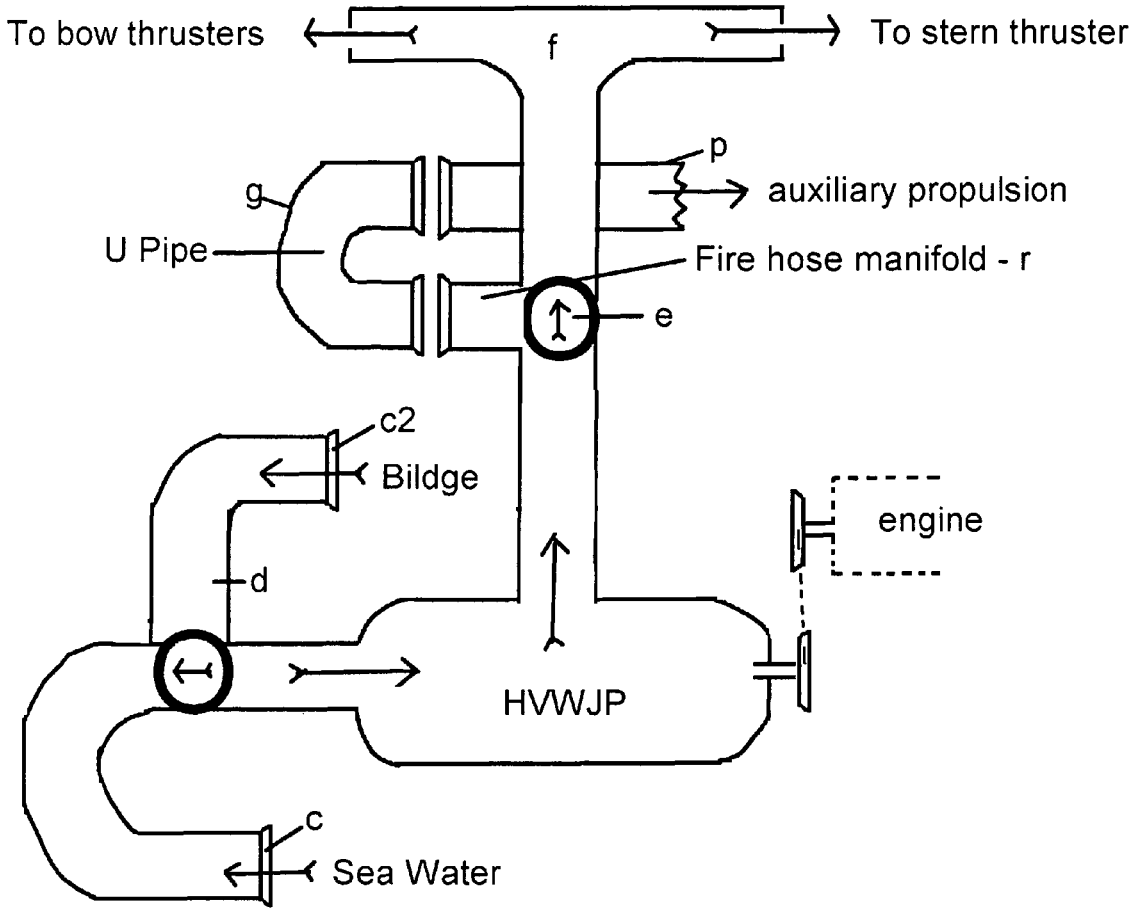
FIG. 4, is an enlarged plan, showing the intake manifold of the HVWJP and valve (d), that can close the sea water suction C, drawing water from the sea and open suction C2, to pump water from the boat's bilges. It also shows an outlet manifold (f), having a similar valve (e), that diverts the pressure water to a fire manifold (r) This fire hose manifold (r) can, in an emergency, be connected with a special U piece (q), to a pipe (p), leading to main propulsion nozzles (s), at the stern, to be further explained later.
Figure 5:
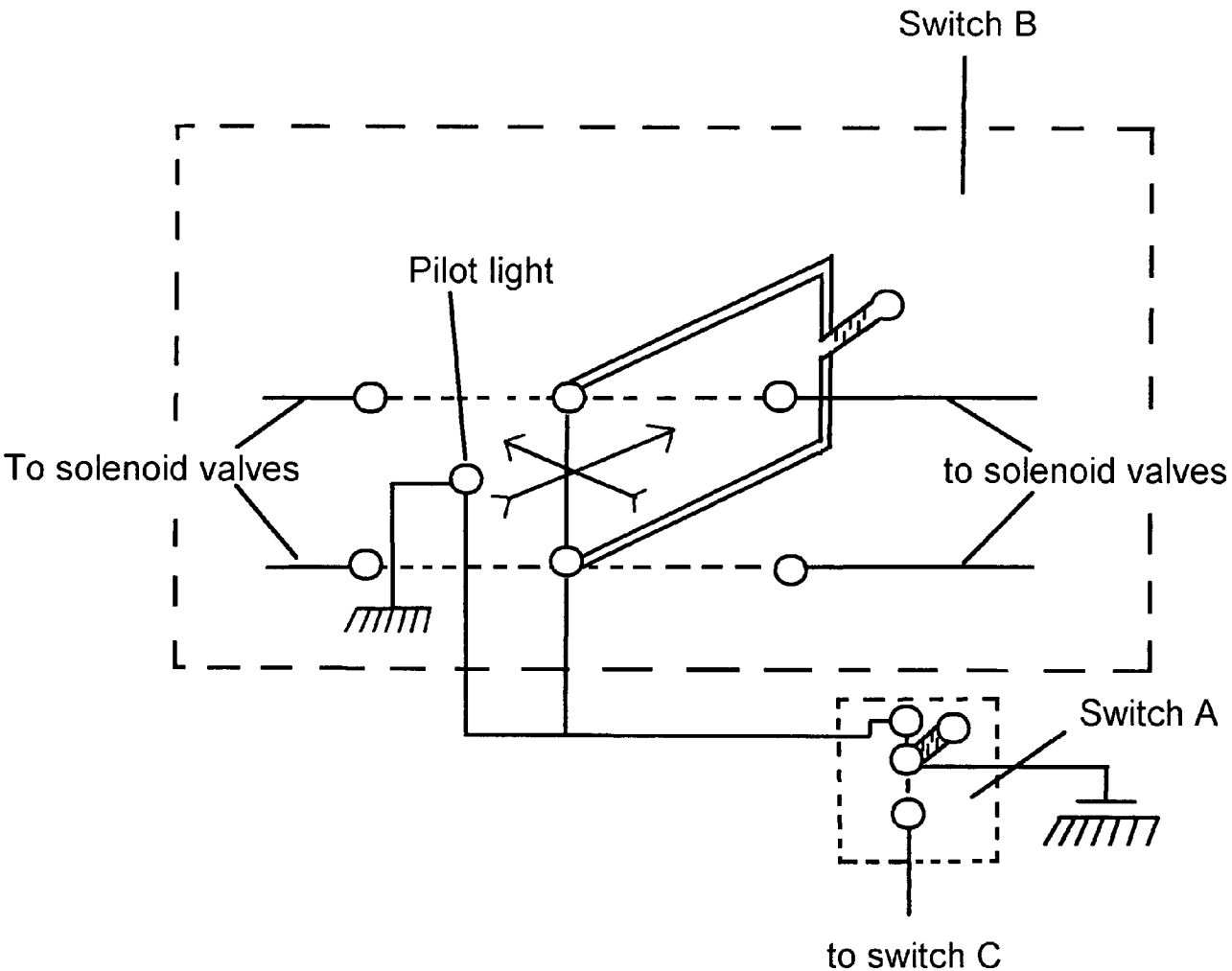
FIG. 5, is an enlarged view plan of switch B, showing the double pole-double throw switch connections to solenoid valves, operating the bow and stern thrusters.

FIG. 3 shows switch A having lighted signals, crossed arrows, when put on one position, indicating the turning movement or, parallel arrows, when put on the second position, indicating the lateral movement.

Switches B and C give also power, through relays, to the electromagnetic clutch of the HVWJP, to come into operation.

Figure 2:
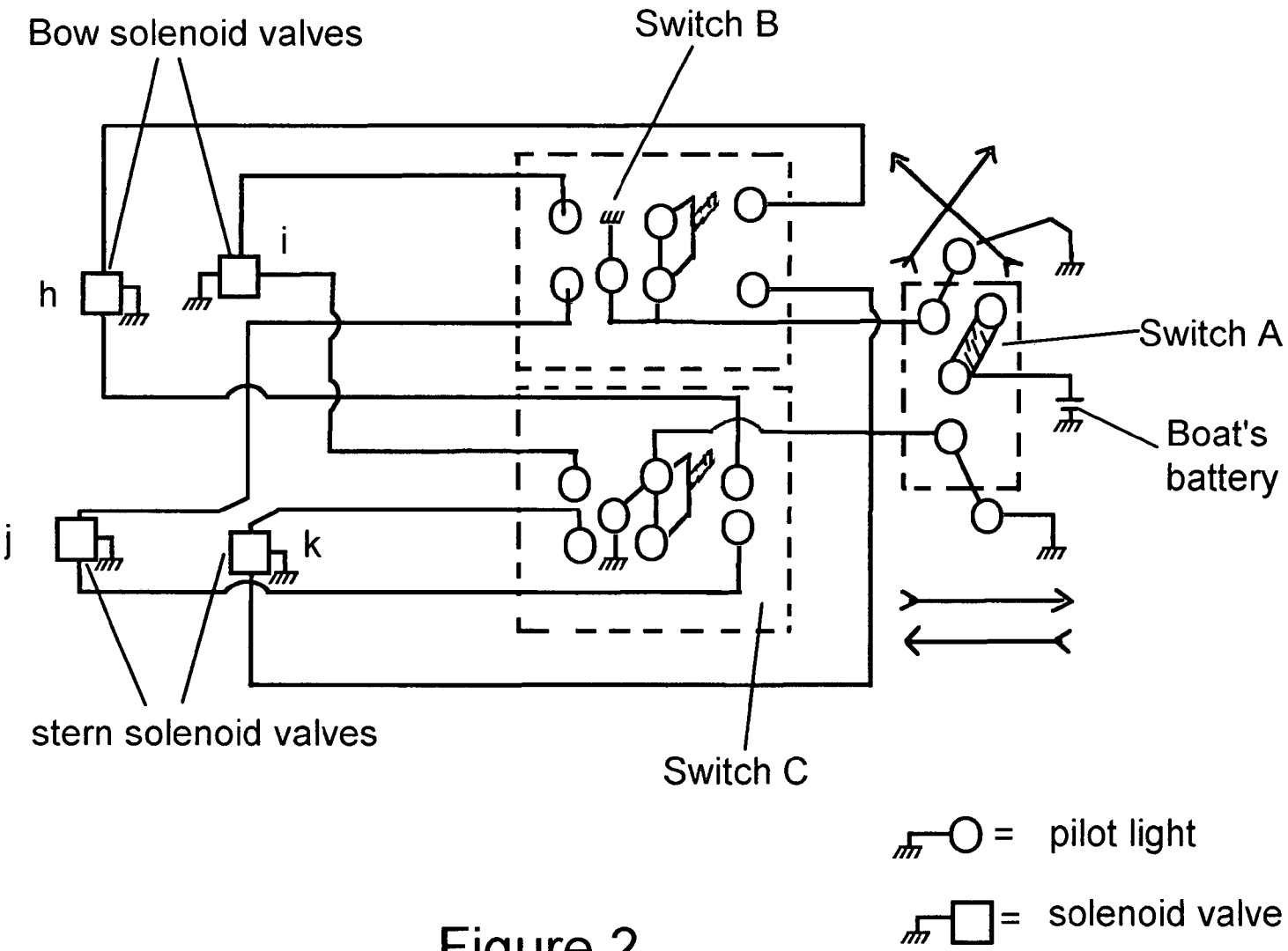
FIG. 2, is an electrical schematic diagram showing the electrical switches A, B and C on the cock-pit, connecting the four solenoid valves (h), (i), (j) and (k), regulating the jet nozzles.

Each water jet outlet consists of several nozzles, specially designed to give maximum thrust. As in FIG. 2, pilot lights are also on the switches B and C, indicating which of the two is energized and what operation will perform.

OBJECTS AND ADVANTAGES

The main advantage of the thruster device of the present invention, over the existing bow thrusters is that the present invention uses, each time, two opposing forces (thrusts), on the two ends of the boat; the action forces on the boat to turn are double and the effect is twice as good and twice as fast.

Furthermore, using the same equipment we have onboard, if we strike a rock and a leak starts that the boat's bilge pumps can not maintain, we can turn the HVWJP intake manifold valve (c) to bilge (c2) and suck the incoming water out from there.

One more advantage, with the equipment onboard is that we can turn, the HVWJP outlet valve (e), to fire manifold (r), connect a fire hose and fight a fire on board, or on any other boat in the vicinity. And finally, if our boat strikes a rock, while speeding, or any other submerged object and the propellers and shafts (i.e., the primary propulsion system) are damaged beyond use, we can install the U section pipe, to connect outlet manifold (r) to pipe (p) and use the HVWJP as auxiliary propulsion and legally avoid being charged with Salvage, instead of Towage, if we need one.

For all above reasons we believe that our thruster device has advantages that the existing bow thrusters do not.

I claim:

1. A device for enhancing the maneuverability of a boat, equipped with one or two inboard engines, comprising:

a. a high velocity water jet pump connectable to a main propulsion engine;

b. electric switches on a dash board of the boat for connecting the high velocity water jet pump to the main propulsion engine, when needed;

c. a high velocity water jet pump outlet manifold, connecting to bow and stern nozzles through solenoid valves;

d. said solenoid valves controlled from a cock pit, by electric switches A, B and C, on the dash board;

e. a high velocity water jet pump intake manifold, having a first branch for drawing water from the sea and a second branch, through a two way valve, that diverts suction of the high velocity water jet pump, when needed, to draw water from bilges, instead of the sea;

f. said high velocity water jet pump outlet manifold, having a first branch for connection to the bow and stern nozzles and a second branch, through a two way valve, that diverts outlet water, to a fire fighting manifold, if and when needed;

g. said electric switch A for supplying power either to said electric switch B, in order to turn the boat to starboard or to port or, to supply power to said electric switch C, in order to move the boat sideways, to right, or to left;

h. said fire fighting manifold, to also be used, in emergencies, to divert a full power of the high velocity water jet pump, using a U section pipe, to at least one transom jet nozzle to propel the boat; and i. said electric switches B and C, through cut off relays, supply also power, from both positions, to connect the high velocity water jet pump to the main propulsion engine, to start the high velocity water jet pump running, when needed.

2. A method by which, water jet thrusts can be used, to enhance the maneuverability of a motorboat or motoryacht comprising, with the device in claim 1, pumping out excess water from the hull, after a damage, and/or fighting a fire on board, or on another vessel nearby and finally, using the device onboard to create an emergency propulsion force, to legally claim and pay towage, instead of salvage fees, if and when needed.

* * * * *